United States Patent [19]

Narayanan et al.

[11] Patent Number: 4,609,381

[45] Date of Patent: Sep. 2, 1986

[54] GRINDING AID

[75] Inventors: Kesh S. Narayanan, Holden; Suresh S. Vagarali, Shrewsbury, both of Mass.

[73] Assignee: Norton Company, Worcester, Mass.

[21] Appl. No.: 681,052

[22] Filed: Dec. 13, 1984

[51] Int. Cl.[4] ..... C09K 3/14

[52] U.S. Cl. ..... 51/298; 51/309

[58] Field of Search ..... 51/298, 309

[56] References Cited

U.S. PATENT DOCUMENTS

| | | | |
|---|---|---|---|
| 2,216,135 | 10/1940 | Rainier | 51/298 |
| 2,308,982 | 1/1943 | Kistler | 51/295 |
| 2,811,430 | 10/1957 | Gregor | 51/298 |
| 2,939,777 | 6/1960 | Gregor | 51/298 |
| 2,940,841 | 6/1960 | Gregor | 51/298 |
| 4,035,162 | 7/1977 | Brothers et al. | 51/308 |
| 4,239,503 | 12/1980 | Harris et al. | 51/295 |
| 4,253,850 | 3/1981 | Rue et al. | 51/296 |
| 4,350,498 | 9/1982 | Zimmer | 51/306 |
| 4,381,188 | 4/1983 | Waizer et al. | 51/298 |

*Primary Examiner*—Paul Lieberman
*Assistant Examiner*—Willie J. Thompson
*Attorney, Agent, or Firm*—Arthur A. Loiselle, Jr.

[57] ABSTRACT

This invention relates to organically bonded abrasive articles that include grinding aids. It has been determined that when known grinding aids such as alkali metal sulphates and alkali metal chlorides are cofused in about eutectic proportions and added to thermoset resin bonded abrasive articles in the form of finely crushed particles having an approximate eutectic composition that an improved abrasive article results.

15 Claims, 1 Drawing Figure

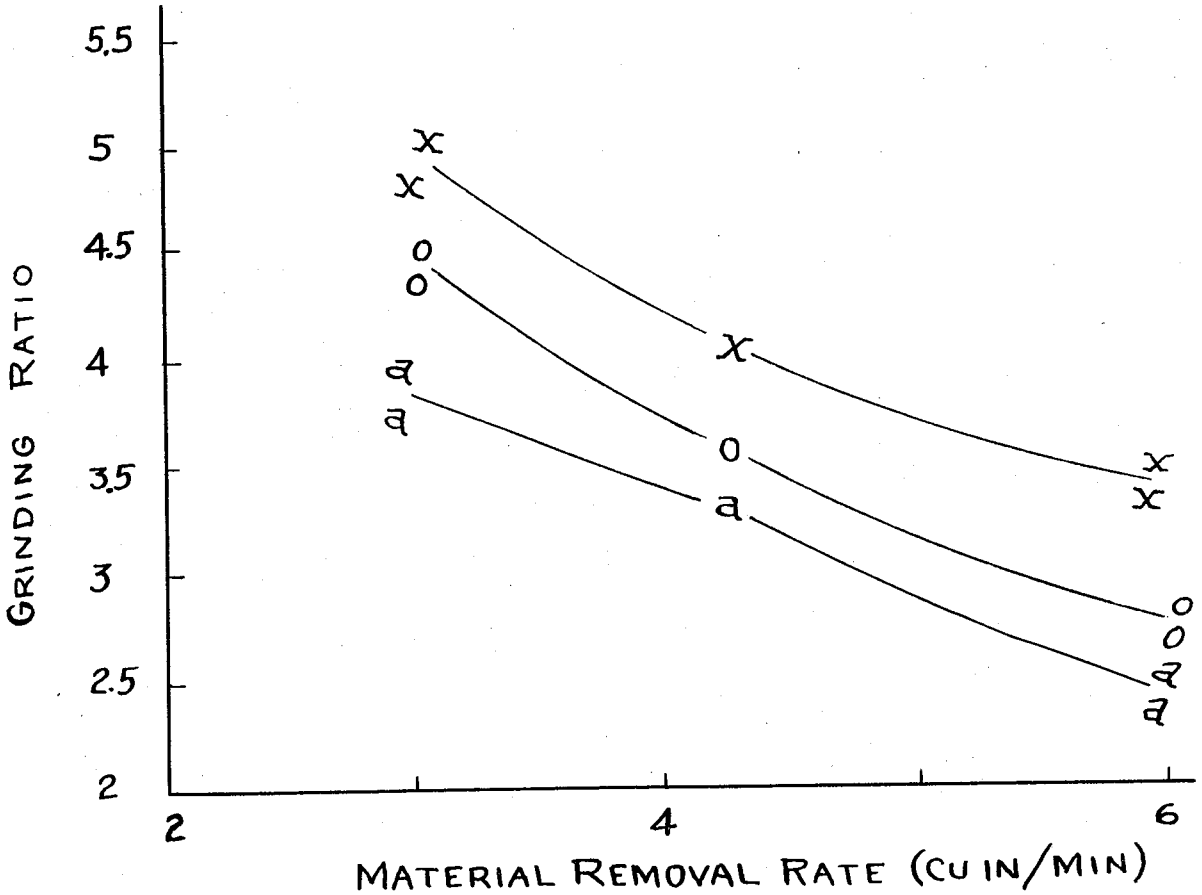
GRINDING RATIO
5.5
5
4.5
4
3.5
3
2.5
2
2
4
6
MATERIAL REMOVAL RATE (CU IN/MIN)

GRINDING AID

TECHNICAL FIELD

This invention relates to the use of grinding aids in organically bonded abrasive articles.

BACKGROUND AND INFORMATION DISCLOSURE STATEMENT

The following publications are illustrative of the most relevant prior art known to the applicant at the time of filing this application:

| U.S. Pat. Nos. | | |
|---|---|---|
| 2,216,135 | Rainier | Oct. 1, 1940 |
| 2,308,982 | Kistler | Jan. 19, 1943 |
| 2,811,430 | Gregor et al | Oct. 29, 1957 |
| 2,939,777 | Gregor et al | June 7, 1960 |
| 2,940,841 | Gregor et al | June 14, 1960 |
| 4,381,188 | Waizer et al | Apr. 26, 1983 |

Organically bonded grinding wheels are shown in these patents which include descriptions of the functioning of various kinds of grinding aids incorporated in such abrasive articles. Rainier suggests the use of sodium chloride in a heat hardenable resin bonded, abrasive article. This grinding aid or any one of several inorganic alkali or alkaline earth metal salts listed in his specification have been found to produce greater volume of metal removal for a given rate of wheel wear. These salts specifically identified by Rainier are: sodium chloride, sodium carbonate, potassium chloride, potassium carbonate, sodium sulphate, potassium sulphate, lithium sulphate, sodium pyrophosphate, potassium pyrophosphate, calcium chloride, calcium bromide, magnesium sulphate, barium chloride, barium bromide, magnesium chloride, magnesium bromide and strontium chloride.

Other grinding aids used with organic bonded abrasives are shown in Kistler who describes the use of a double salt of potassium calcium sulphate. Gregor et al U.S. Pat. No. 2,811,430 suggests the use of a physical mixture of salts with at least one selected from the group consisting of alkali metal salts of sulfuric, hydrochloric and hydrobromic acid together with zinc sulfide. Gregor et al in their U.S. Pat. No. 2,939,777 patent describe the use of these same alkali metal salts with lead sulfide, and in their U.S. Pat. No. 2,940,841 patent, with antimony sulfide. The first two Gregor et al patents state that the most effective physical mixtures of fillers either are at or near the amounts of each filler that would be the eutectic if the two salts were cofused.

Waizer et al is of general interest for the reason that his specification includes a discussion of the various types of fillers used in organically bonded abrasive articles and the purposes for which the respective types of fillers are used. The present invention is concerned with the Waizer et al type 3 "Active Fillers" that apparently undergo a chemical reaction or physical change as the grinding action proceeds that has a positive influence on the behavior of the abrasive during grinding.

It is conventional commercial practice to add combinations of grinding aids in organically bonded abrasive articles and various mixtures of alkali and alkaline metal chlorides, sulphates, sulphides have heretofore been used. It has been found that eutectic mixtures of such salts are preferred in organically bonded grinding wheels in order to improve the grinding ratio thereof.

DISCLOSURE OF THE INVENTION

It has now been discovered that if two of such known grinding aids, for example, potassium sulphate and sodium chloride that improve the grinding ratio of organically bonded abrasive grinding wheels when added individually to the raw batch, are specially prepared i.e. cofused as taught herein prior to their introduction into a mix, a still greater improvement in the grinding ratio can be realized. If eutectic proportions of these two alkali metal salts are first melted together at a temperature above their eutectic melting temperature, but at a temperature below their respective melting points, the rapidly solidified mass resulting from such a fusion, can be crushed to produce a grinding aid that may be added to a mix for producing an organically bonded grinding wheel which results in a still further improvement in the grinding action of that abrasive grinding wheel. Organically bonded wheels include wheels bonded with any of the polymers used for that purpose including phenol-formaldehyde, epoxy, polyester, polyimide, polybenzimidazole, shellac, polyurethane etc.

BRIEF DESCRIPTION OF THE DRAWING

The drawing is a graph showing the grinding ratios of three organically bonded wheels for comparison.

EXAMPLE OF THE PREFERRED EMBODIMENT

The grinding aid of this invention is described herein in its use in a conventional phenolic bonded cut-off wheel containing an alumina abrasive. For this purpose, it has been found that two known alkali metal salts may be fused together and crushed to form the new grinding aid of this invention. The salts selected are combined in about their respective eutectic proportions to form a fusion which occurs at a temperature slightly above the melting temperature of their eutectic but below the melting points of the respective salts. This liquid is poured onto a metal sheet to be rapidly cooled and after being solidified the eutectic composition is crushed to form the new grinding aid.

In a preferred mix for a cut-off wheel for use in grinding stainless steel, a mix containing 60% by weight potassium sulphate and 40% by weight of sodium chloride was used, this being an approximate eutectic mix of these salts. The mixed salt particles were heated together to a temperature of 554° C. which is higher than the melting point of the solidified $K_2SO_4$.NaCl eutectic composition but is below the melting points of the respective salts which are 1069° C. for $K_2SO_4$ and 801° C. for NaCl.

The fused eutectic mass of $K_2SO_4$ and NaCl that solidified on the aluminum sheet was then crushed and ball milled to pass through a 200 mesh U.S. Standard screen. The ball milling was completed with the addition of about 1% by weight of CaO to prevent caking and the ball milled particles were then ready to be added to the raw batch of phenolic resin and abrasive grain for producing cut-off wheels.

Three otherwise conventional cut-off wheels were prepared, one including the cofused and crushed eutectic grinding aid prepared as described above. Another such wheel was made using a conventional $K_2SO_4$ grinding aid as the only additive, this wheel being considered the standard wheel, and still another wheel was prepared in the conventional manner using a non-fused preblended mix of 60% by wt. $K_2SO_4$ and 40% by wt. NaCl.

The wheels had the following volume percent composition:

| | |
|---|---|
| Alumina Abrasive | 50 |
| Porosity | 14 |
| Bond | 36 |

The wheels were made by the procedure given below. The bond used in these wheels consisted of phenolic resin and grinding aid fillers. Further, the resi was divided into two parts: 82 vol % of total resin was in the form of dry powdered resin and the rest (18 vol %) is the form of liquid resin. The first step in making of the wheels is preparation of the dry bond which consists of dry resin powder and the grinding aids. The dry bond formulae for the three wheels studied here are given below.

TABLE 1

| | Dry Bond Formula (Wt %) | | |
|---|---|---|---|
| Material | Wheel 1 | Wheel 2 | Wheel 3 |
| Phenolic resin powder | 45.94 | 46.68 | 46.90 |
| $FeS_2$ | 34.65 | 35.21 | 35.37 |
| $K_2SO_4$ | 19.41 | 10.84 | — |
| NaCl | — | 7.27 | — |
| Fused Eutectic mixture of $K_2SO_4$ and NaCl | — | — | 17.72 |

Dry bonds were prepared by mixing the above ingredients. During mixing, creosote oil was added (20 cc per lb of dry phenolic resin) as a dampening agent.

Next step is the preparation of the "mix" which consists of alumina abrasive and the bond. The mix formulae for the three wheels are given below.

TABLE 2

| | Mix Formula (Wt %) | | |
|---|---|---|---|
| Material | Wheel 1 | Wheel 2 | Wheel 3 |
| Alumina abrasive | 74.41 | 74.69 | 74.77 |
| Liquid phenolic resin | 2.34 | 2.35 | 2.35 |
| Dry bond | 23.25 | 22.96 | 22.88 |

The compositions of the dry bonds are given in Table 1. The mix was prepared by placing the abrasive in the mixer. Then liquid phenolic resin was poured on to the abrasive and mixing was done so that the abrasive grains were coated with the liquid resin. The dry bond was added next. During mixing, the entire mix was sprayed with a liquid (3 cc per lb of mix) containing 60 vol. % Furfural and 40 vol. % chlorinated parafin oil. Finally fumed silica was added (0.001 lb per lb of mix) as an anti-caking agent. The mix was then screened to remove balls and aged for 12 hours. The aged mix was pressed into 16" diameter and 0.130 inch thick grinding wheels. The wheels were then cured at 175° C. for 17 hours. The cured wheels were inspected for strength, balance and dimensional tolerances.

The grinding test was done on Stone M150 cut-off machine with wheels running at 2865 rpm. 2"×2" square cross section bars of 304 stainless steel were used for cutting. Three cut-rates, 5, 7 and 10 sec/cut were used with two wheels for each item tested at 5 and 10 sec/cut, and one wheel at 7 sec/cut. Twenty cuts were made for each wheel. The wheel wear and grinding power were measured. The Grinding Ratio (G-Ratio) was calculated as $$\text{Grinding Ratio} = \frac{\text{Volume of Metal Removed}}{\text{Volume of Wheel Wear}}$$

The comparative grinding results of these three wheels are shown in the graph shown in the drawing. The curve "a" is the standard wheel with the $K_2SO_4$ grinding aid, the curve "O" is the wheel with the non-fused eutectic. Additives and the curve "X" is the cut-off wheel with the fused and crushed eutectic aid. The results show that as the cutting speed of the wheel is increased, the grinding ratio of the wheel with the fused and crushed eutectic grinding aid remains significantly higher than the respective grinding ratios of either the standard wheel with $K_2SO_4$ alone or the wheel with $K_2SO_4$ and NaCl merely mix in the raw batch in eutectic proportions.

The test data recorded during these cut-off runs were as follows:

TABLE 3

| Filler/Wt. % | Relative G Ratio | Relative Power |
|---|---|---|
| 100% $K_2SO_4$ | 100 | 100 |
| Preblended 60% $K_2SO_4$ and 40% NaCl | 111 | 101 |
| Fused-Crushed eutectic, 60% $K_2SO_4$.40% NaCl | 129 | 101 |

This fused crushed eutectic is suggested for use in all forms of conventional organically bonded abrasive articles such as are now improved by the addition of grinding aids of the active filler type. This fused crushed aid will show improved results with all of the various types of conventional abrasive grains used for metal cutting or grinding. This aid is suggested for use in natural and synthetic organic and particularly for phenolic resin bonds for abrasive articles.

The above description is based on the best mode known to the inventor at the present time, and is not to be considered limiting. The product of this invention is a new form of grinding aid adapted to be incorporated in the raw batch mix used for the production of an organically bonded abrasive article to produce a more efficient grinding action than can be performed with the addition of grinding aids known heretofore.

We claim:

1. An abrasive article comprising abrasive grain and a bonding material, said bonding material being a thermoset binder resin and said article including a grinding aid filler, said filler consisting of a cofused near eutectic mix of an alkali metal sulphate and an alkali metal chloride, said mix being crushed prior to being included in said mix.

2. An abrasive article as in claim 1 wherein said alkali metal sulphate is potassium sulphate.

3. An abrasive article as in claim 1 wherein said alkali metal chloride is sodium chloride.

4. An abrasive article as in claim 2 wherein said alkali metal chloride is sodium chloride.

5. An abrasive article as in claim 4 wherein said alkali metal sulphate is present in about 60% by weight and said alkali metal chloride is present in about 40% by weight.

6. An abrasive article as in claim 1 wherein said mix is crushed to all pass through a 200 mesh U.S. Standard screen.

7. A bonded abrasive article comprising an organic bond for abrasive grains and including a grinding aid filler, said filler consisting of a cofused and crushed mixture of an alkali metal sulphate and an alkali metal chloride, said respective alkali metal salts being present in said mixture in a near eutectic proportion.

8. An abrasive article as in claim 7 wherein said alkali metal sulfate is potassium sulphate present in about 60% by weight of said mixture, and alkali metal chloride is sodium chloride present in about 40% by weight of said mixture.

9. A raw batch for making an abrasive grinding article comprising a resin bond formula adapted to be thermoset, abrasive grain, and filler material, certain of said filler material consisting of a near eutectic composition made of an alkali metal sulphate and an alkali metal chloride, said composition being a cofused and crushed composition.

10. A raw batch as in claim 9 wherein said composition is crushed to pass through a 200 mesh U.S. Standard screen.

11. A raw batch as in claim 9 wherein said alkali metal sulphate is present in said composition in about 60% by weight and said alkali metal chloride is present in about 40% by weight.

12. A method of grinding metal with an organically bonded abrasive grinding wheel comprising driving the thermoset resin supported abrasive against the metal being ground in the presence of a grinding aid consisting at least in part of a cofused crushed nearly eutectic composition of an alkali metal sulphate and an alkali metal chloride.

13. A method as in claim 12 wherein the alkali metal sulphate is potassium sulphate.

14. A method as in claim 12 wherein the alkali metal chloride is sodium chloride.

15. A method as in claim 13 wherein the alkali metal chloride is sodium chloride.

* * * * *